US007914631B2

(12) United States Patent
Zeuner et al.

(10) Patent No.: US 7,914,631 B2
(45) Date of Patent: Mar. 29, 2011

(54) GAS-GENERATING COMPOSITION

(75) Inventors: Siegfried Zeuner, Munich (DE); Uwe Reimann, Nuremberg (DE); Roland Schropp, Tegernheim (DE); Karl-Heinz Roedig, Kraiburg (DE)

(73) Assignee: TRW Automotive Airbag Systems GmbH, Aschau am Inn (DE)

( * ) Notice: Subject to any disclaimer, the term of this patent is extended or adjusted under 35 U.S.C. 154(b) by 891 days.

(21) Appl. No.: 11/151,153

(22) Filed: Jun. 13, 2005

(65) Prior Publication Data

US 2006/0144486 A1 Jul. 6, 2006

(30) Foreign Application Priority Data

Jun. 15, 2004 (DE) ..... 20 2004 009 449 U

(51) Int. Cl.

| | |
|---|---|
| ***C06B 31/00*** | (2006.01) |
| ***C06B 31/28*** | (2006.01) |
| ***C06B 31/02*** | (2006.01) |
| ***C06B 29/00*** | (2006.01) |
| ***C06B 29/02*** | (2006.01) |
| ***D03D 23/00*** | (2006.01) |
| ***D03D 43/00*** | (2006.01) |

(52) U.S. Cl. ..... 149/45; 149/46; 149/61; 149/75; 149/77; 149/109.4

(58) Field of Classification Search ..... 149/45, 149/46, 61, 75, 77, 109.4
See application file for complete search history.

(56) References Cited

U.S. PATENT DOCUMENTS

| | | | | |
|---|---|---|---|---|
| 3,306,939 | A | 2/1967 | Hill | |
| 3,767,489 | A | 10/1973 | Reinhart et al. | |
| 3,811,358 | A * | 5/1974 | Morse | 86/20.1 |
| 3,853,646 | A | 12/1974 | Frankel et al. | |
| 5,009,728 | A | 4/1991 | Chan et al. | |
| 6,052,634 | A * | 4/2000 | Pathe et al. | 701/45 |

FOREIGN PATENT DOCUMENTS

| | | |
|---|---|---|
| GB | 1300542 | 12/1972 |
| JP | 49124211 | 11/1974 |
| JP | 49124212 | 11/1974 |

OTHER PUBLICATIONS

English abstract of Journal article entitled "New Aspects of Appliction of Trinitroethanol Derivatives for the Construction of Pyrotechni Gas-Generating Ingredients". Intrl. Annual Conference of ICT (2004), 35th, 140/1-140/11.

* cited by examiner

*Primary Examiner* — James E McDonough
(74) *Attorney, Agent, or Firm* — Tarolli, Sundheim, Covell & Tummino LLP

(57) ABSTRACT

An azide-free gas-generating composition for use in gas generators for safety arrangements, in particular in gas generators for vehicle occupant restraint systems, includes a fuel and an oxidizer. The fuel is a compound having a melting point of at least 120 degrees C., and is selected from the group of nitrogenous organic compounds and of aliphatic dicarboxylic acids, and mixtures, derivatives and salts thereof. The oxidizer comprises tetrakis(2,2,2-trinitroethyl)orthocarbonate (TNEOC), with the TNEOC being present in a proportion of at least 10% by weight of the composition.

18 Claims, No Drawings

GAS-GENERATING COMPOSITION

TECHNICAL FIELD

The invention relates to an azide-free gas-generating composition for use in gas generators for safety arrangements, in particular in gas generators for vehicle occupant restraint systems.

BACKGROUND OF THE INVENTION

Gas generators for safety arrangements usually contain a solid propellent based on sodium azide as the gas-providing main component. Sodium azide is, however, poisonous and can easily become converted with heavy metals forming extremely dangerous and highly reacting compounds. Therefore, both in the production of the gas-generating compositions and also in the disposal of defective or unused gas generators, special measures are necessary.

Furthermore, gas-generating compositions based on nitrogenous organic fuels and inorganic oxidizing agents are known. In the combustion of these compositions, a series of solid substances occur which must be removed from the gas stream by suitable filter arrangements in the gas generator or retained in the gas generator. The use of these compositions requires in addition the use of coated gas bag fabrics in order to prevent damage of the fabric on impingement of hot combustion products. Owing to the high solid content of the reaction products resulting from the combustion of the compositions, the gas yield of these compositions lies distinctly below 80% by weight.

In view of these disadvantages of the known gas-generating compositions, attempts have already been made for the production of propellants which burn substantially smokeless or free of residue. Thus in the U.S. Pat. No. 5,545,272 a gas-generating composition is described which consists substantially of 35 to 55% by weight of nitroguanidine and approximately 45 to 65% by weight of phase-stabilized ammonium nitrate. The addition of phase-stabilizing additives to the ammonium nitrate is considered necessary because a structural change occurring in pure ammonium nitrate at 32.3 degrees C. is connected with an increase in volume which can lead to a fracture of the propellant bodies and hence to an undesired change to the combustion characteristic of the propellant. As phase-stabilizing additives, potassium salts, such as for example potassium nitrate and potassium perchlorate are proposed in a proportion of between 10 to 15% by weight. Ammonium nitrate is, in addition, very hygroscopic, whereby the handling of propellants containing ammonium nitrate is made difficult. The phase changes described above are facilitated also by increased humidity contents.

The U.S. Pat. No. 5,009,728 describes the use of polynitroalkyl compounds as an oxidizing agent in castable, non-sensitive energetic compositions which contain a thermoplastic elastomer as fuel and a plasticizer. One of the polynitroalkyl compounds used as an oxidizer is tetrakis(2,2,2-trinitroethyl)orthocarbonate (TNEOC).

The synthesis of TNEOC is described in U.S. Pat. No. 3,306,939. For this, 2,2,2-trinitroethanol is reacted in the presence of iron(III) chloride with carbon tetrachloride. The various orthoesters of 2,2,2-trinitroethanol described in U.S. Pat. No. 3,306,939 are proposed as a replacement of octogen (HMX) in primary charges of electric igniters. Furthermore, these orthoesters can be used as explosive substances for military applications mixed with trinitrotoluene (TNT).

SUMMARY OF THE INVENTION

It is an object of the invention to provide physiologically harmless propellants for gas generators, which react with a high gas yield by forming a substantially particle-free or smokeless and non-poisonous combustion gas and have a sufficiently high combustion rate and also a good thermal and chemical stability.

According to the invention, an azide-free gas-generating composition for use in gas generators for safety arrangements comprises a fuel and an oxidizer. The fuel is a compound having a melting point of at least 120 degrees C. and is selected from the group consisting of nitrogenous organic compounds and aliphatic dicarboxylic acids and mixtures, derivatives and salts thereof. The oxidizer comprises tetrakis (2,2,2-trinitroethyl)orthocarbonate (TNEOC), with the TNEOC being present in a proportion of at least 10% by weight of the composition.

Use of TNEOC as an oxidizer in a proportion of at least 10% by weight of the composition permits the production of gas-generating compositions with a gas yield of at least 80% and preferably up to 100% by weight, because TNEOC is an organic oxidizer reacting entirely free of residue. Furthermore, TNEOC has an extraordinary stability as compared to other organic oxidizers. After a storage stability test over 408 hours at 110 degrees C., DSC measurements showed no changes to the TNEOC or the gas-generating compositions produced on the basis of TNEOC. Also, no changes occur in the combustion characteristics of the compositions with respect to stresses by temperature change and temperature shocks.

Since gas-generating compositions comprising TNEOC as an organic oxidizer do not release hot particles upon combustion, also the use of gas-generating compositions is possible, which have higher combustion temperatures. This is advantageous because these compositions provide a greater gas volume per weight unit of propellant. The components of the gas bag module using the inventive compositions are stressed less intensively, as compared to use of the gas-generating compositions known from the prior art, despite the higher combustion temperatures, because in the hot gas no, or extremely few, solid particles are present. Particularly a damage of the gas bag fabric, which is caused by the hot particles or slag residues, can therefore be entirely avoided. Furthermore, the construction of the gas generators can be further simplified, because smaller quantities of propellant are necessary and costly filter constructions can be dispensed with.

The fuel in the gas-generating compositions according to the invention preferably includes compounds which have an oxygen balance of between −85% and 0%. Oxygen balance means the quantity of oxygen in % by weight which is released with complete reaction of a compound or a composition to $CO_2$, $H_2O$, $Al_2O_3$, $B_2O_3$, etc. (oxygen overbalance). If the oxygen available in the compound or composition is not sufficient, then the missing amount necessary for complete reaction is indicated with a negative sign (oxygen underbalance). A high, i.e. less negative, oxygen balance is advantageous, because in this case the required quantity of TNEOC as oxidizer can be minimized. In so far as nitrogenous fuels are used, the nitrogen content in the fuel is at preferably at least 35% by weight, in order to ensure a high atmospheric nitrogen content in the combustion gases.

Furthermore, it is favourable if the fuel has a low energy content, i.e. a high negative heat of formation $\Delta H_f$, because hereby the combustion temperatures of the compositions can be lowered. Low combustion temperatures usually lead to a lower proportion of toxic $NO_x$ and carbon monoxide (CO) in the combustion gases.

Fuels with a particularly low energy content are the aliphatic dicarboxylic acids with up to four C atoms, such as for example oxalic acid, fumaric acid and malonic acid or their alkali metal salts, alkaline earth metal salts or transition metal salts. With these fuels, the formation of toxic gases in the combustion products can also be counteracted in that slightly over-balanced compositions, i.e. compositions with a slight excess of TNEOC, are used. Thereby, the occurrence of carbon monoxide as harmful gas is reliably prevented. Aliphatic dicarboxylic acids with more than four carbon atoms are not suited as fuels for the gas-generating compositions according to the invention, owing to their poor oxygen balance.

Examples of fuels with a high oxygen balance are nitrates and nitro-compounds of guanidine, such as guanidine nitrate, aminoguanidine nitrate, diaminoguanidine nitrate, triaminoguanidine nitrate and nitroguanidine, and also the nitrogenous heterocylic compounds such as hexogen (RDX), octogen (HMX), 2,4,6,8,10,12-hexanitro-hexaazatetracyclodecane (CL-20), nitrotriazolone (NTO) and compounds of the group of triazoles, tetrazoles, bietrazoles, tetrazines and imidazoles, such as 5-aminotetrazole.

Particularly preferred as fuels are nitrogen-rich organic compounds with a high, i.e. less negative, oxygen balance, such as for example guanididine nitrate, guanidine dinitramide, guanidine carbonate, guanyl ureadinitramide, nitroguanidine, N.N'-dinitroammeline, 5-aminotetrazole, bitetrazoles and salts thereof, nitrated heterocyles, such as for example nitrotriazolone (NTO), hexogen, keto-RDX, and CL-20.

Preferably, the proportion of TNEOC in the gas-generating composition according to the invention amounts to less than 75% by weight, because otherwise the combustion temperature of the composition in the gas generator is too high. Depending on the requirements for the gas-generating composition, the TNEOC can, however, also be a component of an oxidizer mixture, wherein alkali metal nitrates, alkali metal dinitramides, alkali metal chlorates, alkali metal perchlorates, alkaline earth nitrates, alkaline earth dinitramides, alkaline earth chlorates, alkaline earth perchlorates, ammonium nitrate, ammonium dinitramide, ammonium perchlorate are preferred partners. Furthermore, also transition metal oxides, basic transition metal nitrates, transition metal carbonates, hydrogen carbonates and oxalates can be present in the oxidizer mixture.

The gas-generating composition can, in addition, contain usual additives known in the art, such as combustion moderators, slag-forming agents and processing aids. The additives are usually present in a proportion of 0 to 5% by weight of the composition.

In particular, transition metal compounds and soot are suitable as combustion moderators. The transition metal compounds can be selected from the group of transition metal oxides, hydroxides, nitrates, carbonates and chelate compounds of the transition metals. Examples of this are iron oxides, copper oxides, chromium oxides, zinc oxide, copper chromite, basic copper nitrate, zinc carbonate, copper carbonate and ferrocen. Use of soot as burning moderator has the advantage that soot is favourably priced and reacts free of residue with the formation of carbon dioxide.

Processing adjuvants are in particular the compounds selected from the group of pressure aids, trickling aids or lubricants. Examples of such processing adjuvants are polyethylene glycol, cellulose, methyl cellulose, graphite, wax, magnesium stearate, zinc stearate, boron nitride, talcum, bentonite, silicon dioxide or molybdenum sulphide.

Finally, it can be advantageous to add a polymeric binder to the gas-generating composition. The binder can be present in a proportion of 0 to 25% by weight. Suitable binders are, in particular, polyurethane (PU), polypropylene (PP), polyethylene (PE), polyamide (PA), polycarbonate, polyester, polyether, hydroxy-terminated polybutadiene (HTPB), cellulose acetate butyrate (CAB), glyzidylazide polymer (GAP) and silicon rubbers and also the copolymers thereof. A binder content of over 25% of the composition is to be avoided owing to the poor oxygen balance of these compounds of less than −150%.

DETAILED DESCRIPTION OF PREFERRED EMBODIMENTS

Further advantages of the invention will be apparent from the following description of particularly preferred embodiments which, however, are not to be understood in a limiting sense.

Example 1

33.0 parts by weight of guandidine nitrate and 67.0 parts by weight of TNEOC were ground, mixed with each other and compressed into tablets. The theoretical density of the pressed body amounts to 1.68 g/cm$^3$. From thermodynamic calculations, for this composition a combustion temperature of 3,219 K results at a combustion pressure of approximately 300 bar. The composition of the gas resulting from the combustion was entirely free of particles. The gas yield, calculated as the ratio of the weight of the gaseous combustion products to the weight of the gas-generating composition, amounts to 100%. No formation of condensed solids was observed.

The calculated proportion of carbon monoxide in the gaseous combustion products amounts to approximately 0.04‰, the proportion of nitrous oxides $NO_x$ is approximately 0.07‰. In addition, a temperature storage test was carried out at 110 degrees C. for 408 hours using the above composition. A comparison of the composition stored under these conditions with an untreated composition did not result in any change to the decomposition point in the DSC measurement.

Example 2

30 parts by weight of nitroguanidine and 70 parts by weight of TNEOC were ground, mixed with each other and compressed into tablets. The theoretical density of the compressed body was 1.80 g/cm$^3$. From thermodynamic calculations, for this composition a combustion temperature of 3,387 K results at a combustion pressure of approximately 300 bar. The composition of the gas resulting from the combustion was entirely free of particles. The gas yield, calculated as the ratio of the weight of the gaseous combustion products to the weight of the gas-generating composition used, amounts to 100%. Condensed solids were not detectable.

The calculated proportion by weight of carbon monoxide in the composition of the gas resulting from the combustion in this case amounts to approximately 1.16‰, the nitrous oxide ($NO_x$) proportion is approximately 0.07‰. In the temperature storage test at 110 degrees C. for 408 hours, no change occurred to the decomposition point of the composition in the DSC measurement.

Example 3

62.0 parts by weight of 3-nitro-1,2,4-triazol-5-one (NTO), 10 parts by weight of TNEOC and 28 parts by weight of sodium nitrate were ground, mixed with each other and compressed into tablets. The theoretical density of the compressed body amounts to 1.99 g/cm$^3$. From thermodynamic calculations, a combustion temperature of 2,748 K results for the composition at a combustion pressure of approximately 300 bar.

The gas yield of the mixture, calculated as the ratio of the weight of the gaseous combustion products to the weight of the gas-generating composition used amounts to 83.2%. The condensed products were predominantly sodium carbonate. The calculated carbon monoxide proportion in the composition of the gas resulting from the combustion amounts to approximately 12.7‰, the nitrous oxide ($NO_x$) proportion is below the detection threshold. In the temperature storage test at 110 degrees C. for 408 hours, the composition showed no change to the decomposition point in the DSC measurement. The mixture was therefore sufficiently stable.

Further fuels which together with TNEOC as oxidizer produce stable gas-generating compositions are shown in the following table. The fuels are preferably used in a stoichiometric mixture with TNEOC.

| Fuel | Heat of Formation $\Delta H_f$ [kcal/mol] | Oxygen Balance [%] | Nitrogen Content [% by weight] |
|---|---|---|---|
| guanidine nitrate | −92.5 | −26.21 | 45.9 |
| guanidine carbonate | −232.3 | −79.92 | 46.6 |
| guanidine perchlorate | −74.35 | −5.01 | 26.3 |
| aminoguanidine nitrate | −66.62 | −29.18 | 51.1 |
| diaminoguanidine nitrate | −37.56 | −31.55 | 55.2 |
| triaminoguanidine nitrate- | −11.5 | −33.51 | 58.7 |
| nitroguanidine | −22.2 | −30.75 | 53.8 |
| aminonitroguanidine | 5.3 | −33.59 | 58.8 |
| RDX (hexogen) | 16.8 | −21.61 | 37.8 |
| keto-RDX | −10.3 | −6.78 | 35.6 |
| HMX (octogen) | 21 | −21.61 | 37.8 |
| 3-nitro-1,2,4-triazol-5-one | −31 | −24.6 | 43.1 |
| CL-20 | 101 | −10.95 | 38.6 |
| diammonium bitetrazole | 58.88 | −74.35 | 81.4 |
| 5-amino-1H-tetrazole | 50 | −65.83 | 82.3 |
| N.N'-dinitroammeline | −27.25 | −18.42 | 45.2 |
| oxalic acid | −198.63 | −17.77 | 0 |
| fumaric acid | −193.85 | −82.7 | 0 |

The invention claimed is:

1. An azide-free gas-generating composition for use in gas generators for safety arrangements consisting of:

a fuel selected from the group of compounds consisting of nitrogenous organic compounds and aliphatic dicarboxylic acids, as well as mixtures, derivatives and salts thereof, each of the fuel compounds having a melting point of at least 120 degrees C.;

an oxidizer selected from tetrakis(2,2,2-trinitroethyl)orthocarbonate (TNEOC) and TNEOC in combination with an inorganic oxidizer, wherein the TNEOC is present in a proportion of at least 10% by weight of the composition;

a polymeric binder in an amount of from 0 to about 25 percent by weight of the composition; and conventional additives in an amount of between 0 to about 5 percent by weight of the total composition, wherein the conventional additives are selected from the group of combustion moderators, and processing aids, the combustion moderators being selected from transition metal oxides, transition metal hydroxides, transition metal nitrates, transition metal carbonates, chelate compounds of the transition metals, and soot, and the processing aids being selected from polyethylene glycol, cellulose, methyl cellulose, graphite, wax, magnesium stearate, zinc stearate, boron nitride, talcum, bentonite, silicon dioxide or molybdenum sulphide.

2. The composition of claim 1, wherein the fuel has an oxygen balance of between −85% and 0%.

3. The composition of claim 1, the at least one fuel being selected from the group consisting of oxalic acid, fumaric acid, malonic acid and derivatives and salts thereof.

4. The composition of claim 1, the at least one fuel being selected from the group consisting of guanidine compounds, hexogen, octogen, NTO, CL2O, triazoles, tetrazoles, bitetrazoles, tetramines, imidazoles and combinations thereof.

5. The composition of claim 1, the composition comprising from about 10 to 75% TNEOC by weight.

6. The composition of claim 1, the oxidizer consisting of TNEOC.

7. The composition of claim 1, the oxidizer consisting of a mixture of TNEOC and an inorganic oxidizer.

8. The composition according to claim 7, wherein the at least one inorganic oxidizer is selected from the group consisting of alkali metal nitrates, alkali metal dinitramides, alkali metal chlorates, alkali metal perchlorates, alkaline earth nitrates, alkaline earth dinitramides, alkaline earth chlorates, alkaline earth perchlorates, ammonium nitrate, ammonium dinitramide, ammonium perchlorate, transition metal oxides, basic transition metal nitrates, transition metal carbonates, hydrogen carbonates, oxalates and combinations thereof.

9. The composition of claim 1, wherein the polymeric binder is selected from the group consisting of polyurethane (PU), polypropylene (PP), polyethylene (PE), polyamide (PA), polycarbonate, polyester, polyether, hydroxy-terminated polybutadiene (HTPB), cellulose acetate butyrate (CAB), glyzidylazide polymer (GAP), silicon rubber and co-polymers thereof.

10. The composition of claim 1, the composition consisting of the fuel and TNEOC.

11. The composition of claim 7, the composition consisting of the fuel, TNEOC and the inorganic oxidizer.

12. A gas-generating composition for use in gas generators for safety arrangements consisting of:

a fuel selected from the group consisting of guanidine nitrate, nitroguanidine and NTO;

an oxidizer comprising TNEOC and an inorganic oxidizer selected from the group consisting of alkali metal nitrates and alkaline earth metal nitrates and combinations thereof the TNEOC comprising at least 10 percent by weight of the composition; and a conventional additive selected from the group of combustion moderators, and processing aids, the conventional additive comprising 0 to about 5 percent by weight of the composition, wherein the combustion moderators are selected from transition metal oxides, transition metal hydroxides, transition metal nitrates, transition metal carbonates, chelate compounds of the transition metals, and soot, and wherein the processing aids are selected from polyethylene glycol, cellulose, methyl cellulose, graphite, wax, magnesium stearate, zinc stearate, boron nitride, talcum, bentonite, silicon dioxide or molybdenum sulphide.

13. The composition of claim 1, comprising a gas yield of at least 80% in relation to the weight of the composition.

14. The composition of claim 1, comprising a storage stability of at least 408 h at 110 degrees C.

15. A method of operating a vehicle occupant restraint system, the method comprising the steps of:

providing a gas generator including a gas generating composition, said gas generating composition consisting of a fuel selected from the group of compounds consisting of nitrogenous organic compounds and aliphatic dicarboxylic acids, as well as mixtures, derivatives and salts thereof, wherein each of the fuel compounds has a melting point of at least 120 degrees C., an oxidizer selected from tetrakis(2,2,2-trinitroethyl)orthocarbonate (TNEOC) and TNEOC in combination with an inorganic oxidizer, wherein the TNEOC is present in a proportion of at least 10% by weight of the composition; a polymeric binder in an amount of between 0 to about 25 percent by weight of the composition: and conventional additives in an amount of between 0 to about 25 percent by weight of the total composition, wherein the conventional additives are selected from the group of combustion moderators and processing aids, the combustion moderators being selected from transition metal oxides, transition metal hydroxides, transition metal nitrates, transition metal carbonates, chelate compounds of the transition metals, and soot, and the processing aids being selected from polyethylene glycol cellulose, methyl cellulose, graphite, wax, magnesium stearate, zinc stearate, boron nitride, talcum, bentonite, silicon dioxide or molybdenum sulphide;

activating and reacting said gas generating composition in said gas generator to produce a gas, and releasing said gas from said gas generator to operate said vehicle occupant restraint system, the gas being produced in a gas yield of at least 80% by weight of said gas generating composition.

16. The method of claim 15, the gas generator being included in a gas bag module.

17. The method of claim 16, the gas generator being included in a belt tensioner module.

18. An azide-free gas-generating composition for use in gas generators for safety arrangements consisting of:

a fuel selected from the group of compounds consisting of nitrogenous organic compounds and aliphatic dicarboxylic acids, as well as mixtures, derivatives and salts thereof, each of the fuel compounds having a melting point of at least 120 degrees C.;

an oxidizer selected from tetrakis(2,2,2-trinitroethyl)orthocarbonate TNEOC) and TNEOC in combination with an inorganic oxidizer, wherein the TNEOC is present in a proportion of at least 10% by weight of the composition; a polymeric binder in an amount of from 0 to about 25 percent by weight of the composition; and conventional additives in an amount of between 0 to about 5 percent by weight of the total composition, wherein the gas generating composition upon combustion produces a substantially particle-free or smokeless combustion gas.

* * * * *

UNITED STATES PATENT AND TRADEMARK OFFICE

CERTIFICATE OF CORRECTION

PATENT NO. : 7,914,631 B2
APPLICATION NO. : 11/151153
DATED : March 29, 2011
INVENTOR(S) : Siegfried Zeuner et al.

It is certified that error appears in the above-identified patent and that said Letters Patent is hereby corrected as shown below:

Column 7, Line 14, after "0 to about" delete "25" and insert --5.--

Signed and Sealed this
Fourteenth Day of June, 2011

David J. Kappos

David J. Kappos
*Director of the United States Patent and Trademark Office*